US010147403B1

(12) United States Patent
Perry, Jr.

(10) Patent No.: US 10,147,403 B1
(45) Date of Patent: Dec. 4, 2018

(54) ORGAN PEDAL HOLSTER AND METHOD OF USE

(71) Applicant: William Perry, Jr., Thomasville, GA (US)

(72) Inventor: William Perry, Jr., Thomasville, GA (US)

( * ) Notice: Subject to any disclaimer, the term of this patent is extended or adjusted under 35 U.S.C. 154(b) by 0 days.

(21) Appl. No.: 15/945,410

(22) Filed: Apr. 4, 2018

Related U.S. Application Data

(60) Provisional application No. 62/640,694, filed on Mar. 9, 2018.

(51) Int. Cl.
*G10C 3/26* (2006.01)

(52) U.S. Cl.
CPC ..... *G10C 3/26* (2013.01)

(58) Field of Classification Search
CPC ..... G10C 3/26
See application file for complete search history.

(56) References Cited

U.S. PATENT DOCUMENTS 2,784,633 A * 3/1957 Hess ..... G10C 5/00 84/171
8,022,283 B1 * 9/2011 Williams, Jr. ..... G10C 3/26 84/423 R

* cited by examiner

*Primary Examiner* — Kimberly Lockett
(74) *Attorney, Agent, or Firm* — Eldredge Law Firm, LLC; Richard Eldredge; Beth Felix

(57) ABSTRACT

A pedal system for an organ pedal includes a holster having a body forming a U-shaped configuration, the body having a top surface; an inner surface; and two opposing sidewalls configured to removably engage with the organ pedal and configured to form a snug fit between the inner surface and an outer surface of the organ pedal; and an electronic pedal configured to engage with the holster and conductively coupled to an electronic device.

5 Claims, 4 Drawing Sheets

ORGAN PEDAL HOLSTER AND METHOD OF USE

1. FIELD OF THE INVENTION

The present invention relates generally to an apparatus for keyboard players, and more specifically, an apparatus for keyboard players that play a keyboard on top of an organ and the ability to place their sustain pedal in a fixed position while playing the organ.

2. DESCRIPTION OF RELATED ART

Organ pedals are well known in the art and provide means for changing the way the organ sounds while playing a song. FIG. 1 is an oblique view of an organ 101 having a body 103 with a plurality of organ keys 109 and pedals 105. During use, the player will typically sit on bench 107 while playing the key 109 with his hands and while pressing the pedals 105 with his feet.

It will be appreciated that the organ pedals allow the sounds being played to continue until the player takes his foot off the pedal. Although effective in most applications of use, it should be understood that organ 101 has limitations and opportunities for improvements exist. It is believed that the present invention is an improvement over existing organ setups.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
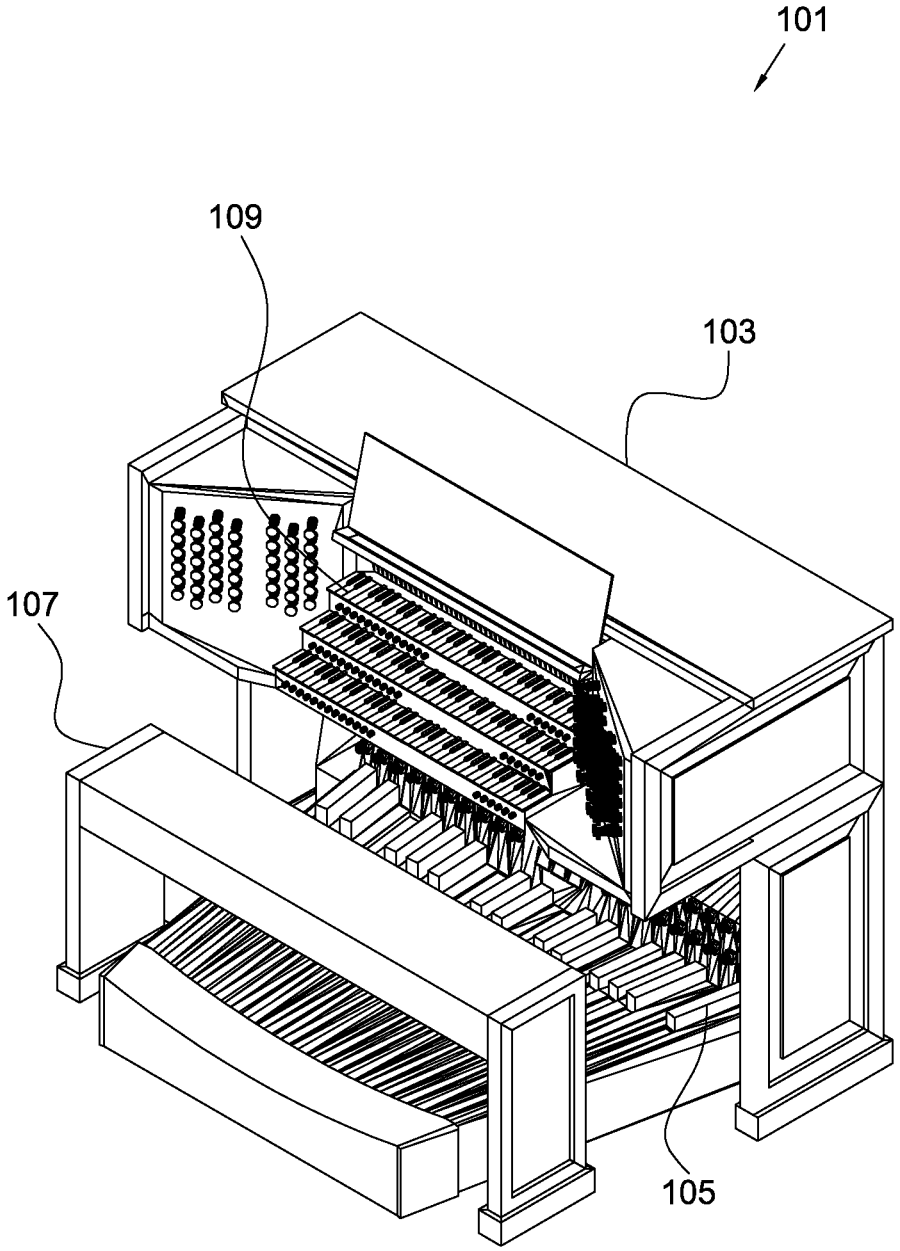
FIG. 1 (PRIOR ART)
FIG. 1 is an oblique view of a conventional organ.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-4 depict various embodiments of pedal system for an organ and method of use. It should be understood that the embodiments discussed herein are substantially similar in form and function and share one or more of the features discussed in each embodiment although the features may not be shown specifically with reference to the particular embodiment.

Figure 2:
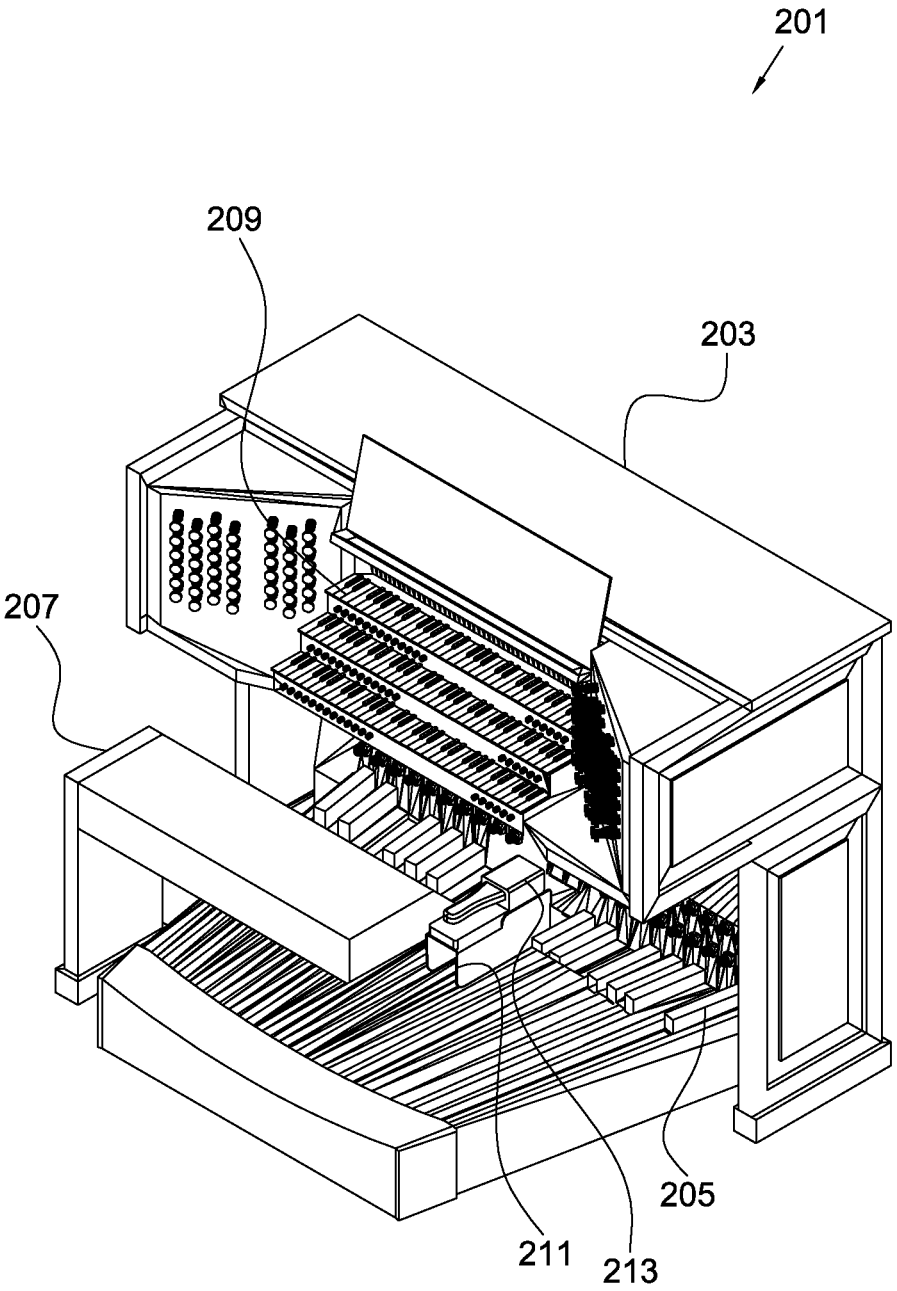
FIG. 2 is an oblique view of a pedal system for an organ and method of use in accordance with a preferred embodiment of the present application.
Figure 3A:
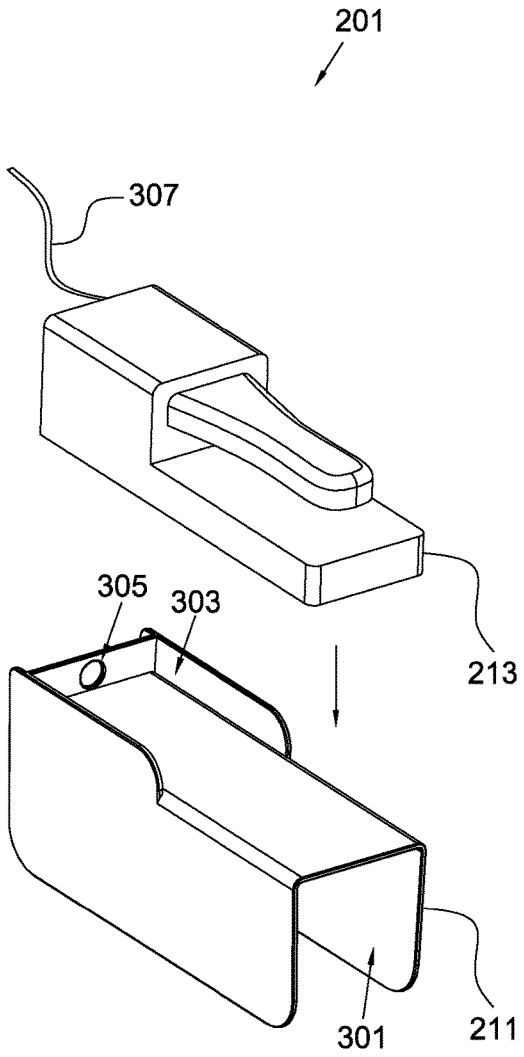
FIGS. 3A and 3B are oblique views of the pedal as shown in FIG. 2.
Figure 3B:
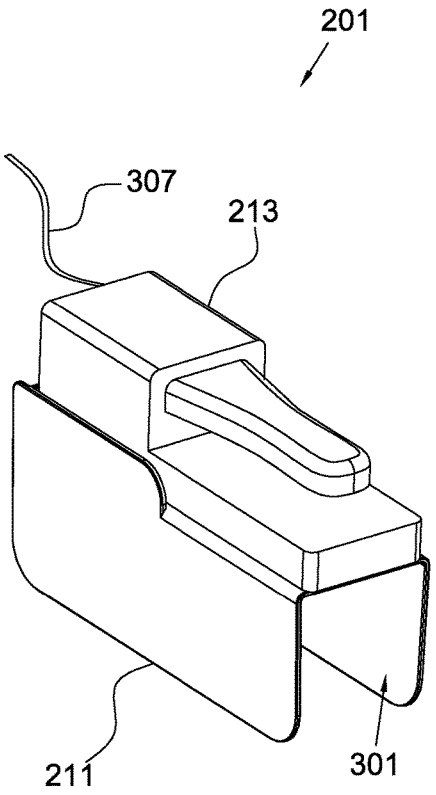
Figure 4:
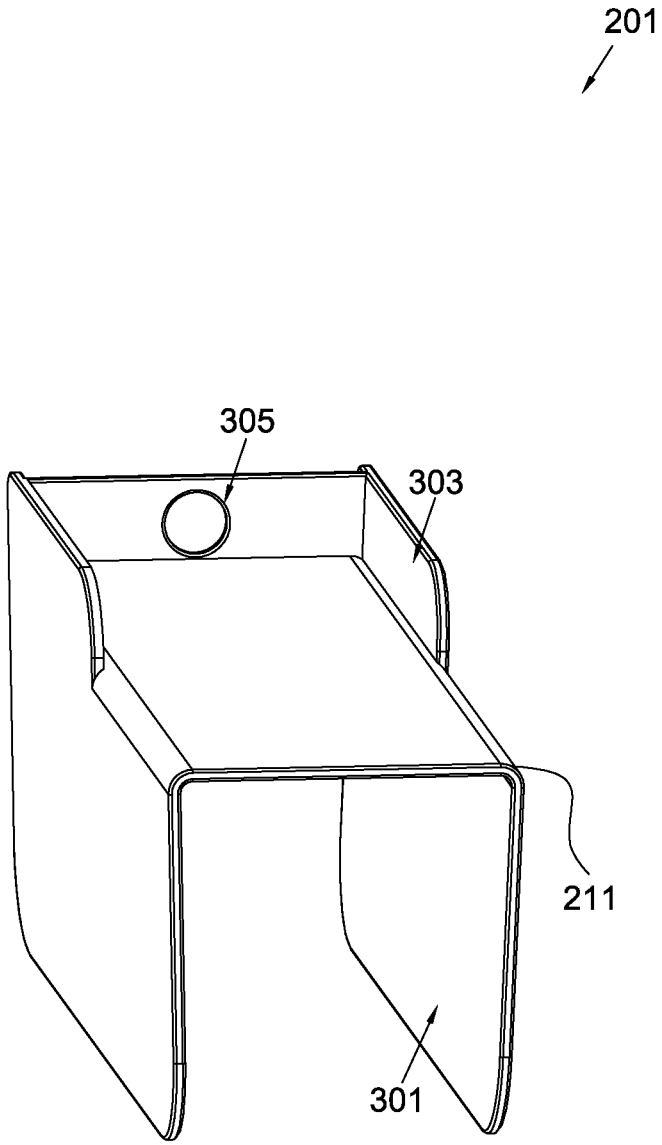
FIG. 4 is a front oblique view of the holster of the system of FIG. 3A.

Referring specifically to FIGS. 2-4, various views of pedal system 201 is shown operably associated with the foot pedals 205 of an organ 203. In FIG. 2, an oblique view of the foot pedal system 201 is shown secured to one of the plurality of foot pedals 205 and configured to secure thereto during use. In one preferred method of use, the player sits on bench 207 while playing keys 209 with his hands. The player has the option of pressing the electronic pedal 213 of system 201 and/or one or more of the pedals 205 of organ 203. To achieve this feature, the pedal system 201 is provided with a with a holster 211 tailored to removably secure to one or more pedals 205.

In one embodiment, the pedal system 201 is operably associated with a keyboard (not shown) that can be placed on the organ 203. In this embodiment, the player can change the sound of the music from the keyboard while pressing on the electronic pedal 213 while also playing the organ. As shown in FIG. 3A, the electronic pedal 213 includes a cord 307 that extends from the pedal and is configured to conductively engage with the keyboard and/or other similar device. It will be appreciated that the pedal could be utilized with other types of musical instruments and/or other types of electrical devices.

In FIGS. 3A and 3B, respective disassembled and assembled views of the pedal system 201 are shown. In the preferred embodiment, the electronic pedal 213 removably attaches to the holster 211 via a rim 303 that extends around a top surface of the holster 211 and is optionally secured in the desired position via a locking device 305, which could be a slot, hole, and/or other fastening means to secure the pedal and the holster in the fixed position, as shown in FIG. 3B.

The holster 211 includes side walls forming a U-shaped configuration with an opening that is adapted to receive the pedal therein. During assembly, the foot pedal fits within the opening of the sidewalls and is secured thereto via pressure fitting of an inner surface 301. As shown in FIG. 4, the sidewalls extend inwardly toward each other to form a spring-loaded attachment between the organ pedal 205 and the holster 211.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A pedal system for an organ pedal, comprising:

a holster, having:

a body forming a U-shaped configuration, the body having:

a top surface;

an inner surface; and two opposing sidewalls configured to removably engage with the organ pedal and configured to form a snug fit between the inner surface and an outer surface of the organ pedal; and an electronic pedal configured to engage with the holster and conductively coupled to an electronic device;

wherein pressure applied to the electronic pedal manipulates the electronic device.

2. The system of claim 1, the holster further comprising:

a rim extending around a portion of the top surface;

wherein the rim is configured to engage with the electronic pedal.

3. The system of claim 1, wherein the electronic device is a keyboard.

4. The system of claim 1, the holster further comprising:

a fastening device configured to secure the electronic pedal to the holster.

5. The system of claim 1, further comprising:

an electric cord extending from the electronic foot pedal to the electronic device.

* * * * *